US008147671B2

(12) United States Patent
Sun et al.

(10) Patent No.: US 8,147,671 B2
(45) Date of Patent: Apr. 3, 2012

(54) ELECTROPLATING METHOD AND ELECTROPLATED PRODUCT

(75) Inventors: Jipeng Sun, Shenzhen (CN); Aihua Li, Shenzhen (CN); Zaichun Li, Shenzhen (CN); Bo Peng, Shenzhen (CN)

(73) Assignee: BYD Co. Ltd., Shenzhen (CN)

( * ) Notice: Subject to any disclaimer, the term of this patent is extended or adjusted under 35 U.S.C. 154(b) by 197 days.

(21) Appl. No.: 12/623,727

(22) Filed: Nov. 23, 2009

(65) Prior Publication Data

US 2010/0167085 A1 Jul. 1, 2010

(30) Foreign Application Priority Data

Dec. 26, 2008 (CN) ..... 2008 1 0241685

(51) Int. Cl.
*C25D 5/10* (2006.01)
*C25D 5/12* (2006.01)
*C23C 28/02* (2006.01)

(52) U.S. Cl. ..... 205/176; 205/177; 205/178; 205/182; 205/184; 205/185; 205/187

(58) Field of Classification Search ..... 205/176, 205/177, 178, 182, 184, 185, 187
See application file for complete search history.

(56) References Cited

U.S. PATENT DOCUMENTS

| | | | | | |
|---|---|---|---|---|---|
| 2,689,216 | A * | 9/1954 | Nevers et al. | ..... | 205/292 |
| 3,108,006 | A * | 10/1963 | Gore et al. | ..... | 427/437 |
| 5,246,565 | A * | 9/1993 | Nignardot | ..... | 205/181 |
| 6,183,880 | B1 * | 2/2001 | Yoshioka et al. | ..... | 428/607 |
| 6,416,571 | B1 * | 7/2002 | Kaneko et al. | ..... | 106/1.18 |
| 6,528,184 | B2 * | 3/2003 | Man et al. | ..... | 428/675 |
| 6,692,630 | B2 * | 2/2004 | Morin et al. | ..... | 205/143 |
| 7,052,592 | B2 * | 5/2006 | Edigaryan | ..... | 205/287 |

FOREIGN PATENT DOCUMENTS

| | | | | |
|---|---|---|---|---|
| CN | 1097644 | C | | 1/2003 |
| CN | 1197499 | C | | 4/2005 |
| CN | 1659316 | A | | 8/2005 |
| CN | 101122037 | A | * | 2/2008 |
| CN | 101139711 | A | * | 3/2008 |
| WO | WO 2008/003216 | A1 | | 1/2008 |

* cited by examiner

*Primary Examiner* — Edna Wong

(74) *Attorney, Agent, or Firm* — Brinks Hofer Gilson & Lione

(57) ABSTRACT

A method for electroplating a substrate having an aluminum alloy surface comprises: applying a zinc layer onto the aluminum alloy surface; electroplating a first copper layer onto the zinc layer from an alkaline copper electroplating solution; electroplating a second copper layer onto the first copper layer from an acid copper electroplating solution; electroplating a Cu—Sn alloy layer onto the second copper layer from a Cu—Sn electroplating solution; and electroplating a chromium layer onto the Cu—Sn alloy layer from a trivalent chromium solution. The alkaline copper electroplating solution is substantially free of cyanide ion.

19 Claims, No Drawings

ELECTROPLATING METHOD AND ELECTROPLATED PRODUCT

CROSS REFERENCE TO RELATED APPLICATION

This application claims priority to Chinese Patent Application No. 200810241685.3, filed on Dec. 26, 2008, the entirety of which is hereby incorporated by reference.

FIELD

The present disclosure relates to electroplating methods and electroplated products made therefrom.

BACKGROUND

Because of their small density, good ductility and toughness, easy molding processing, good electrical conductivity, thermal conductivity, and other physical properties, aluminum alloys have been widely used in modern aviation, aerospace, electric power, electronics, petroleum, chemicals, building materials, transportation, light industry, and national defense industries. However, as a typical amphoteric metal, aluminum is prone to corrosion in both acid and alkaline environments, which limits the applications of aluminum and its alloys. In addition, the surface hardness and wear resistance of aluminum alloy are poor. Usually, surface treatment is used to overcome these shortcomings and improve the product performance. The main methods include: oxidation treatment, electroplating, plastic coating, and spray painting.

Electroplating is the most widely used method. On the one hand, it can retain or even strengthen the main physical properties, such as electrical conductivity, thermal conductivity, mechanical performance, etc. On another hand, it can avoid the corrosion of acid and base environments, and expand the application of aluminum alloys. Furthermore, electroplating can improve the decorative effect on the surface of the aluminum alloys.

In general, two electroplating processes are used for aluminum alloys. For example, the alloys are pre-treated, dipped into a zinc-containing solution, coated with a nickel layer by a chemical method, electroplated by a copper layer, electroplated by a nickel layer, and electroplated by a chromium or gold layer. The other process includes pre-treating, dipping into a zinc-containing solution, electroplating a copper layer from a cyanide copper solution, electroplating a copper layer from a pyrophosphate copper solution, electroplating copper from an acid copper solution, electroplating a nickel layer, and electroplating a chromium or gold layer. These processes have shortcomings, such as poor adhesion of the electroplated layers, high costs, difficult treatments of waste water, and serious environmental pollutions. The main disadvantages of nickel electroplating include that exterior appearance may be affected by the nickel deposition, and nickel would cause some people to have allergic reactions. The current nickel-free electroplating processes include cyanide Cu—Sn alloy electroplating, cyanide-free Sn—Co alloy electroplating, cyanide-free Sn—Zn—Co alloy electroplating, cyanide-free Sn—Zn alloy electroplating, and so on. The cyanide-free alloys do not contain cyanide, but the color of the coatings is not bright. The technique of cyanide Cu—Sn alloy electroplating is relatively mature, but the high toxicity of cyanides limits its application, and cyanide may cause serious environmental pollutions.

Therefore, a nickel-free and cyanide-free process is desirable to electroplate aluminum alloys.

SUMMARY

In one aspect, a method for electroplating a substrate having an aluminum alloy surface comprises: applying a zinc layer onto the aluminum alloy surface; electroplating a first copper layer onto the zinc layer from an alkaline copper electroplating solution; electroplating a second copper layer onto the first copper layer from an acid copper electroplating solution; electroplating a Cu—Sn alloy layer onto the second copper layer from a Cu—Sn electroplating solution; and electroplating a chromium layer onto the Cu—Sn alloy layer from a trivalent chromium solution. The alkaline copper electroplating solution is substantially free of cyanide ion.

In another aspect, a method for electroplating a substrate having an aluminum alloy surface comprises: applying a zinc layer onto the aluminum alloy surface; electroplating a first copper layer onto the zinc layer from an alkaline copper electroplating solution; electroplating a second copper layer onto the first copper layer from an acid copper electroplating solution; applying an activating solution onto the second copper layer; electroplating a Cu—Sn alloy layer onto the second copper layer from a Cu—Sn electroplating solution; and electroplating a chromium layer onto the Cu—Sn alloy layer from a trivalent chromium solution. The alkaline copper electroplating solution is substantially free of cyanide ion.

In yet another aspect, an electroplated product comprises a substrate having an aluminum alloy surface; a zinc layer on the aluminum alloy surface; a copper layer on the zinc layer, a Cu—Sn alloy layer on the copper layer; and a chromium layer on Cu—Sn alloy layer. The copper layer is formed by electroplating from an alkaline copper electroplating solution, and the alkaline copper solution is substantially free of cyanide ion. The electroplated layers are substantially free of nickel.

DETAILED DESCRIPTION

It will be appreciated by those of ordinary skill in the art that the embodiments disclosed herein can be embodied in other specific forms without departing from the spirit or essential character thereof. The presently disclosed embodiments are therefore considered in all respects to be illustrative and not restrictive.

A cyanide-free and nickel-free electroplating method for a substrate having an aluminum alloy surface comprises: applying a zinc layer onto the aluminum alloy surface; electroplating a first copper layer onto the zinc layer from an alkaline copper electroplating solution; electroplating a second copper layer onto the first copper layer from an acid copper electroplating solution; electroplating a Cu—Sn alloy layer onto the second copper layer from a Cu—Sn electroplating solution; and electroplating a chromium layer onto the Cu—Sn alloy layer from a trivalent chromium solution. The alkaline copper electroplating solution is substantially free of cyanide ions. The phrase "substantially free of cyanide ions" is intended to refer to a solution that has no more than a negligible amount of cyanide ions. In other words, there are not enough cyanide ions to change the characteristics, including the environmental impact, of the electroplating solution.

Preferably, the zinc layer is formed by placing the substrate into a zinc-containing solution. Preferably, the zinc-containing solution is an aqueous solution, comprising zinc oxide, sodium hydroxide, potassium sodium tartrate, ferric chloride, and sodium nitrite. More preferably, the concentration of zinc oxide is between about 20 and about 60 g/L. The concentration of sodium hydroxide is between about 100 and about 130 g/L. The concentration of potassium sodium tartrate is between about 40 and about 60 g/L. The concentration of ferric chloride is between about 0.5 and about 2.5 g/L. The concentration of sodium nitrite is between about 0.5 and about 4 g/L.

Preferably, the temperature of the zinc-containing solution is between about 20 and about 28° C. The substrate is placed in the zinc-containing solution for between about 40 seconds and about 2 minutes. The zinc-containing solution can be any suitable solution containing zinc. It can be prepared in house, and can also be bought in the market. For example, HAI-201 zinc-containing solution (Fulite Chemical Co., Ltd. ShenZhen), Zincate CNF zinc-containing solution (Tongdao Technologies Co., Ltd. ShenZhen), and other commercially available products can be used in the present disclosure.

In some embodiments, the non-conductive impurities on the surface of the substrate material may affect the adhesion of the electroplated layers. For example, cast or forged aluminum substrates containing a high content of silicon are difficult to be electroplated. To obtain a substrate with a smooth surface, the silicon residual impurities should be removed. The removal of residual impurities can be achieved by two times of treatment with zinc-containing solutions. The substrate is placed in a first zinc-containing solution and coated with a zinc layer. After the zinc layer is removed, the substrate is coated with another layer of zinc from a second zinc-containing solution. The first layer of zinc can be removed with a solution of nitric acid and sodium fluoride. Preferably, the weight percentage of nitric acid is about 50%. The weight percentage of sodium fluoride is about 2%. The reaction can be carried out at room temperature for about 5 to about 10 seconds. The first and second zinc-containing solution can be the same solution. The conditions of the second treatment can also be the same as the first treatment, except that the placing time is about 10 to about 20 seconds.

After the treatment with the zinc-containing solution, a beige uniform layer is formed on the surface. This layer may have a strong adhesive force with both the substrate surface and the subsequent electroplated layers.

The alkaline copper electroplating solution can be any suitable basic copper solution. Preferably, the alkaline copper electroplating solution comprises potassium pyrophosphate, copper pyrophosphate, a stabilizing agent, a brightening agent, and water. The concentration of potassium pyrophosphate is between about 350 and about 420 g/L. The concentration of copper pyrophosphate is between about 15 and about 25 g/L. The concentration of the stabilizing agent is between about 65 and about 85 ml/L. The concentration of the brightening agent is between about 15 and about 25 ml/L.

Preferably, the electroplating of the first copper layer is conducted at a temperature between about 35 and about 60° C., at a cathodic current density between about 0.5 and about 2.5 A/dm$^2$, and at a pH value between about 9.2 and about 10.0. The electroplating time can be between about 5 minutes and about 20 minutes.

The alkaline copper electroplating solution can be prepared in house or bought in the market. For example, the RK series cyanide-free alkaline copper (NNK Co., Japan), SF-628 cyanide-free alkaline copper series (Sanfu Co., Ltd. Guangzhou), CuMac Strike XD7453 electroplating solution (MacDermid Co., US), and other commercially available products can be used.

The acid copper electroplating is performed after the cyanide-free alkaline copper electroplating. It can increase the surface brightness of product and improve the visual effect. Any suitable acid copper electroplating solution can be used. Preferably, the acid copper electroplating solution is an aqueous solution, comprising $CuSO_4$, $H_2SO_4$, chloride ion, an auxiliary agent, a smoothing agent, and a brightening agent.

More preferably, the concentration of $CuSO_4$ is between about 180 and about 250 g/L. The concentration of $H_2SO_4$ is between about 50 and about 70 g/L. The concentration of chloride ion is between about 40 and about 100 mg/L. The concentration of the auxiliary agent is between about 8 and about 10 ml/L. The concentration of the smoothing agent is between about 0.4 and about 0.6 ml/L. The concentration of the brightening agent is between about 0.4 and about 0.6 ml/L.

In one embodiment, the concentration of $CuSO_4$ is about 220 g/L. The concentration of $H_2SO_4$ is about 50 g/L. The concentration of chloride ion is about 100 mg/L. The concentration of the auxiliary agent is about 8 ml/L. The concentration of the smoothing agent is about 0.5 ml/L. The concentration of the brightening agent is about 0.5 ml/L. The acid copper electroplating solution can be prepared in house or be commercially available products, such as Ultra acid copper electroplating solution (Atotech Co., China). The Ultra solution (Atotech Co., China) comprises $CuSO_4.5H_2O$ of about 195 to 255 g/L, $H_2SO_4$ of about 45 to 55 g/L, chlorine ion of about 40 to 100 mg/L, an auxiliary agent (ULTRA Make Up) of about 8 to 10 ml/L, a smoothing agent (ULTRA A) of about 0.4 to 0.6 ml/L, a brightening agent (ULTRA B) of about 0.4 to 0.6 ml/L.

Preferably, the electroplating of the second copper layer is conducted at a temperature between about 20 and about 30° C., and at a cathodic current density between about 3 and about 5 A/dm$^2$. Preferably, the electroplating time is between about 15 minutes and about 40 minutes. Preferably, the electroplating solution is stirred and filtered during the electroplating process. The electroplating solution can remain relatively uniform by stirring. Filtering can remove impurities from the electroplating solution.

Preferably, a copper ball containing phosphorus of about 0.03 to 0.06% by weight is used as an anode in the electroplating.

Any suitable Cu—Sn alloy electroplating solution can be used. Preferably, the Cu—Sn alloy electroplating solution is an aqueous solution. Preferably, the solution comprises potassium pyrophosphate of about 250 to 350 g/L, copper pyrophosphate of about 5 to 12 g/L, stannous pyrophosphate of about 15 to 35 g/L, a complexing agent of about 80 to 120 ml/L, a stabilizing agent of about 10 to 30 ml/L, and a brightening agent of about 10 to 20 ml/L. Preferably, the conditions of the Cu—Sn alloy electroplating comprise a temperature of about 15 to 30° C., a cathodic current density of about 0.5 to 1 A/dm$^2$, a pH value of about 8.0 to about 8.8, and a electroplating time of about 5 minutes to about 15 minutes. The Cu—Sn alloy electroplating solution can be prepared in house or be commercially available products, such as FSC white Cu—Sn (Mateys Co., Guangzhou), CS-138 white Cu—Sn system (Dazhi Chemical Technology Co., Ltd. Guangzhou), and so on.

Any suitable chromium electroplating solution can be used. Preferably, the trivalent chromium electroplating solution is an aqueous solution. Preferably, the solution comprises an auxiliary agent of about 400 to 450 ml/L, a stabilizing agent of about 55 to 75 g/L, a wetting agent of about 2 to 5 ml/L, a complexing agent of about 1 to 3 ml/L, and trivalent chromium of about 20 to 25 g/L. In one embodiment, the concentration of the auxiliary agent is about 420 ml/L, the concentration of the stabilizing agent is about 65 g/L, the concentration of the wetting agent is about 3 ml/L, the concentration of the complexing agent is about 2 ml/L, and the concentration of the trivalent chromium is about 22 g/L. The electroplating solutions can be prepared in house or be commercially available products, such as TVC-trivalent chromium electroplating solution (Shangma Technology Co., Ltd. Shenzhen). The conditions of electroplating comprise a temperature of about 28 to 35° C., a cathodic current density of about 8 to 30 A/dm$^2$, a pH value of about 2.5 to about 3.0, and a electroplating time of about 1 minute to about 5 minutes. The anode can be a titanium alloy sheet or graphite. The electroplating solution can remain relatively uniform by stirring. Filtering can remove impurities from the electroplating solution. The electroplating solution can be recycled by a filtering machine.

Preferably, the aluminum alloy surface is pretreated before coating the zinc layer. The pretreatment can comprise the following five steps.

1. Mechanical polishing. The surface of the alloy is polished by a high-speed polishing machine.

2. Dewaxing and degreasing. The alloy is placed into a degreasing and dewaxing fluid to remove waxes and greases. The degreasing and dewaxing fluid can be Procleaner BR#1 dewaxing fluid (YongXing Chemical Industry Co., Ltd.), or NO. 630 electrolysis degreasing powder (International Chemical Industry Co., Ltd).

3. Alkaline etching. The alloy is placed into an alkaline solution for a period of time to remove oxides and silicon. The alkaline solution can comprise sodium hydroxide of about 40 to 60 g/L, and ammonium bifluoride of about 90 to 120 g/L. The sodium hydroxide can further remove greases, natural oxide films, and slight scratches. The ammonium bifluoride can be used to remove the silicon on the surface of alloy.

4. Film removing. The aluminum alloy after treatment with alkaline solutions has a non-uniform grey or black film on its surface. The film can be removed by a film-removing solution. The film-removing solution can comprise nitric acid with volume fraction of about 30 to 40%, phosphoric acid with volume fraction of about 50% to 70%, and ammonium bifluoride of about 5 to 30 g/L. The temperature can be about 20 to 35° C.

5. Surface conditioning. Although the non-uniform black film is removed by a film removing solution, an oxide layer is formed on the surface of the alloy. A surface correcting solution can be used to remove the oxide layer and neutralizing the surface. The solution can comprise sodium carbonate of about 2 to 4 g/L. Preferably, the treatment temperature is about 20 to 28° C. The treatment time is about 30 seconds to about 1 minute.

Preferably, the aluminum alloy surface receives an activating treatment before and after the Cu—Sn alloy electroplating to remove the oxide film on its surface. Any suitable activating treatment can be used. Preferably, an activating solution is used to active the electroplated layers. In one embodiment, the activating solution is a hydrochloric acid or sulfuric acid solution with a mass fraction of about 5%. The activating time is between about 30 seconds to about 1 minute.

The surface of the substrate can be any type of aluminum alloys, such as AC8A, TL177, ZL303, and KS282 aluminum alloys.

In some embodiments, electroplated products manufactured by the above methods are disclosed. An electroplated product comprises a substrate having an aluminum alloy surface; a zinc layer on the aluminum alloy surface; a copper layer on the zinc layer, a Cu—Sn alloy layer on the copper layer; and a chromium layer on Cu—Sn alloy layer. The copper layer is formed by electroplating from an alkaline copper electroplating solution, and the alkaline copper solution is substantially free of cyanide ion. The electroplating layers are substantially free of nickel. The phrase "substantially free of nickel" is intended to refer to the layer that has no more than a negligible amount of nickel.

The following embodiments are electroplating methods and products according to the present disclosure.

EXAMPLE 1

The substrate material is AC8A aluminum alloy. It is treated by the following steps.

(1) Mechanical Polishing.

The surface material is polished by a high speed polishing machine. The surface roughness is reduced and the glossiness of the surface is enhanced.

(2) Ultrasonic Dewaxing.

The Procleaner BR1 dewaxing fluid (YongXing Chemical Industry Co., Ltd.) is used. The initial concentration is about 30 ml/L. The temperature is about 65° C. The treatment time is about 5 minutes.

(3) Cathodic Electrolytic Degreasing.

The NO. 630 electrolysis degreasing powder (International Chemical Industry Co., Ltd) is used. The initial amount is about 50 g/L. The temperature is about 65° C. The current density is about 5 A/dm$^3$. The treatment time is about 1 minute.

(4) Alkaline Etching.

The alkaline solution includes sodium hydroxide with an initial concentration of about 40 g/L, and ammonium bifluoride with an initial concentration of about 90 g/L. The temperature is about 25° C. The treatment time is about 1 minute.

(5) Film Removing.

The film-removing solution includes nitric acid with a volume fraction of about 30%, phosphoric acid with a volume fraction of about 70%, and about 10 g/L ammonium hydrogen fluoride. The temperature is about 25° C. The treatment time is about 20 seconds.

(6) Surface Conditioning.

The surface correcting solution contains sodium carbonate with a concentration of about 2 g/L. The temperature is room temperature, and the treatment time is about 1 minute.

(7) Zinc Coating.

The zinc-containing solution comprises zinc oxide with a concentration of about 20 g/L, sodium hydroxide with a concentration of about 100 g/L, potassium sodium tartrate with a concentration of about 40 g/L, ferric chloride with a concentration of about 0.5 g/L, and sodium nitrite with a concentration of about 0.5 g/L. The electroplating temperature is about 23° C. and the electroplating time is about 60 seconds.

(8) Cyanide-Free Alkaline Copper Electroplating.

The CuMac Strike XD7453 electroplating solution (MacDermid Co., US) is used, which comprises CuMac Strike Make up solution with a concentration of about 125 ml/L, Equivalent copper meta with a concentration of about 4.5 g/L, CuMac Strike Stabilizer with a concentration of about 60 ml/L, and CuMac Strike Buffer with a concentration of about 40 ml/L. The temperature is about 60° C. The cathodic current density is about 1 A/dm$^2$. The pH value is about 9.5 and the electroplating time is about 20 minutes.

(9) Acid Copper Electroplating.

The Ultra Acid Copper electroplating solution (Atotech Co., China) is used, which comprises $CuSO_4.5H_2O$ with a concentration of about 195 g/L, $H_2SO_4$ with a concentration of about 45 g/L, chlorine ion with a concentration of about 45 mg/L, an auxiliary agent ULTRA Make Up with a concentration of about 8 ml/L, a smoothing agent ULTRA A with a concentration of about 0.4 ml/L, a brightening agent ULTRA B with a concentration of about 0.4 ml/L. The conditions of electroplating comprise a temperature of about 25° C., and a cathodic current density of about 4 A/dm$^2$. The anode is a copper ball containing phosphorus at about 0.05% by weight. The electroplating time is about 30 minutes. The solution is stirred and filtered during the electroplating process.

(10) Activating Treatment.

The activating solution is a $H_2SO_4$ solution with a mass fraction of about 5%. The activating time is about 30 seconds and the activating temperature is room temperature.

(11) Cu—Sn Alloy Electroplating.

The FSC White Cu—Sn (Mateys Co., Guangzhou) is used, which comprises potassium pyrophosphate with a concentration of about 250 g/L, copper pyrophosphate with a concentration of about 5 g/L, stannous pyrophosphate with a concentration of about 15 g/L, a complexing agent FCS-A with a concentration of about 80 ml/L, a stabilizing agent FCS-B with a concentration of about 10 ml/L and a brightening agent FCS-C with a concentration of about 10 ml/L. The temperature is about 20° C., the cathodic current density is about 0.5 A/dm$^2$, the pH value is about 0.5, and the electroplating time is about 5 minutes.

(12) Activating Treatment.

The activating solution is a HCl solution with a mass fraction of about 5%, the activating time is about 30 seconds and the activating temperature is room temperature.

(13) Trivalent Chromium Electroplating.

The TVC-trivalent chromium electroplating solution (Shangma Technology Co., Ltd. Shenzhen) is used, which comprises an auxiliary agent TVC-BC with a concentration of about 400 ml/L, a stabilizing agent TVC-CAT with a concentration of about 55 ml/L, a wetting agent TVC-MS with a concentration of about 2 ml/L, a complexing agent TVC-EXT with a concentration of about 1 ml/L, and trivalent chromium with a concentration of about 20 g/L. The temperature is about 25° C., the cathodic current density is about 14 A/dm$^2$, the pH value is about 2.8, the electroplating time is about 1 minute. The solution is stirred mechanically and filtered continuously.

The alloy is washed with water after each step.

The electroplated product is labeled as A1.

EXAMPLE 2

The substrate material is YL177 aluminum alloy. It is treated by the following steps.

The steps (1)-(6) are the same as described in EXAMPLE 1.

(7) Zinc Coating.

The zinc-containing solution comprises zinc oxide with a concentration of about 40 g/L, sodium hydroxide with a concentration of about 125 g/L, potassium sodium tartrate with a concentration of about 50 g/L, ferric chloride with a concentration of about 1.5 g/L, and sodium nitrite with a concentration of about 2 g/L. The temperature is about 23° C. and the time is about 45 seconds.

(8) Cyanide-Free Alkaline Copper Electroplating

The CuMac Strike XD7453 electroplating solution (MacDermid Co., US) is used, which comprises CuMac Strike Make up solution with a concentration of about 150 ml/L, Equivalent copper metal with a concentration of about 5.5 g/L, CuMac Strike Stabilizer with a concentration of about 60 ml/L, and CuMac Strike Buffer with a concentration of about 50 ml/L. The temperature is about 60° C., the cathodic current density is about 1 A/dm$^2$, the pH value is about 9.5 and the electroplating time is 2 minutes.

(9) Acid Copper Electroplating.

The Ultra acid copper electroplating solution (Atotech Co., China) is used, which comprises $CuSO_4.5H_2O$ with a concentration of about 220 g/L, $H_2SO_4$ with a concentration of about 50 g/L, chlorine ion with a concentration of about 100 mg/L, ULTRA Make Up with a concentration of about 8 ml/L, a smoothing agent ULTRA A with a concentration of about 0.5 ml/L, a brightening agent ULTRA B with a concentration of about 0.5 ml/L. The conditions of acid copper electroplating comprise a temperature of about 25° C., and a cathodic current density of about 3.5 A/dm$^2$. The anode is a copper ball containing phosphorus at about 0.05% by weight. The electroplating time is about 25 minutes. The solution is stirred and filtered continuously.

(10) Activating Treatment.

The activating solution is a $H_2SO_4$ solution with a mass fraction of about 5%. The activating time is about 30 seconds, and the activating temperature is room temperature.

(11) Cu—Sn Alloy Electroplating.

The FSC white Cu—Sn electroplating solution (Mateys Co., GuangZhou) is used, which comprises potassium pyrophosphate with a concentration of about 320 g/L, copper pyrophosphate with a concentration of about 10 g/L, stannous pyrophosphate with a concentration of about 25 g/L, a complexing agent FCS-A with a concentration of about 100 ml/L, a stabilizing agent FCS-B with a concentration of about 20 ml/L, and a brightening agent FCS-C with a concentration of about 15 ml/L. The temperature is about 25° C., the cathodic current density is about 0.8 A/dm$^2$, the pH value is about 8.5, and the electroplating time is about 10 minutes.

(12) Activating Treatment.

The activating solution is a HCl solution with a mass fraction of about 5%. The activating time is about 30 seconds, and the activating temperature is room temperature.

(13) Trivalent Chromium Electroplating

The TVC-trivalent chromium electroplating solution (Shangma Technology Co., Ltd. Shenzhen) is used, which comprises TVC-BC with a concentration of about 420 ml/L, a stabilizing agent TVC-CAT with a concentration of about 65 ml/L, a wetting agent TVC-MS with a concentration of about 3 ml/L, a complexing agent TVC-EXT with a concentration of about 2 ml/L, and trivalent chromium with a concentration of about 22 g/L. The temperature is about 32° C., the cathodic current density is about 14 A/dm$^2$, and the pH value is about 2.8. The electroplating time is about 2 minute. The solution is stirred mechanically and filtered continuously.

The alloy is washed with water after each step.

The electroplated product is labeled as A2.

EXAMPLE 3

The substrate material is ZL102 aluminum alloy. It is treated with the following steps.

The steps (1)-(6) are the same as in EXAMPLE 1.

(7) Zinc Coating.

The zinc-containing solution comprises zinc oxide with a concentration of about 60 g/L, sodium hydroxide with a concentration of about 130 g/L, potassium sodium tartrate with a concentration of about 60 g/L, ferric chloride with a concentration of about 1.5 g/L, and sodium nitrite with a concentration of about 3.5 g/L. The temperature is about 20° C. and the time is about 2 minutes.

(8) Cyanide-Free Alkaline Copper Electroplating.

The CuMac Strike XD7453 electroplating solution (MacDermid Co., US) is used, which comprises CuMac Strike Make Up solution with a concentration of about 200 ml/L, Equivalent Copper Metal with a concentration of about 7.5 g/L, CuMac Strike Stabilizer with a concentration of about 70 ml/L, and CuMac Strike Buffer with a concentration of about 80 ml/L. The temperature is about 35° C., the cathodic current density is about 1 A/dm$^2$, the pH value is about 9.5, and the electroplating time is about 5 minutes.

(9) Acid Copper Electroplating.

The Ultra acid copper electroplating solution (Atotech Co., China) is used, which comprises $CuSO_4.5H_2O$ with a concentration of about 225 g/L, $H_2SO_4$ with a concentration of about 55 g/L, chlorine ion with a concentration of about 100 mg/L, ULTRA Make Up with a concentration of about 10 ml/L, a smoothing agent ULTRA A with a concentration of about 0.6 ml/L, a brightening agent ULTRA B with a concentration of about 0.6 ml/L. The conditions of acid copper electroplating comprise a temperature of about 25° C., a cathodic current density of about 4 A/dm$^2$. The anode is a copper ball containing phosphorus of about 0.05% by weight. The electroplating time of about 25 minutes. The solution is stirred mechanically and filtered continuously.

(10) Activating Treatment.

The activating solution is $H_2SO_4$ with a mass fraction of about 5%. The activating time is about 30 seconds, and the activating temperature is room temperature.

(11) Cu—Sn Alloy Electroplating.

The FSC white Cu—Sn (Mateys Co., GuangZhou) is used, which comprises potassium pyrophosphate with a concentration of about 350 g/L, copper pyrophosphate with a concentration of about 12 g/L, stannous pyrophosphate with a concentration of about 35 g/L, a complexing agent FCS-A with a concentration of about 120 ml/L, a stabilizing agent FCS-B with a concentration of about 30 ml/L, and a brightening agent FCS-C with a concentration of about 20 ml/L. The temperature is about 32° C., the cathodic current density is about 1 A/dm$^2$, the pH value is about 8.5, and the electroplating time is about 10 minutes.

(12) Activating Treatment.

The activating solution is a HCl solution with a mass fraction of about 5%. The activating time is about 30 seconds, and the activating temperature is room temperature.

(13) Trivalent Chromium Electroplating.

The TVC-trivalent chromium electroplating solution (Shangma Technology Co., Ltd. Shenzhen) is used, which comprises TVC-BC with a concentration of about 450 ml/L, a stabilizing agent TVC-CAT with a concentration of about 75 ml/L, a wetting agent TVC-MS with a concentration of about 5 ml/L, a complexing agent TVC-EXT with a concentration of about 3 ml/L, and trivalent chromium with a concentration of about 25 g/L. The temperature is about 32° C., the cathodic current density is about 14 A/dm$^2$, the pH value is about 2.8, the electroplating time is about 5 minutes. The solution is stirred mechanically and filtered continuously.

The alloy is washed with water after each step of treatment.

The electroplated product is labeled as A3.

EXAMPLE 4

The substrate material is AC8A aluminum alloy. It is treated with the following steps.

The steps (1)-(6) are the same as in EXAMPLE 1.

(7) Zinc Coating.

The zinc-containing solution comprises zinc oxide with a concentration of about 40 g/L, sodium hydroxide with a concentration of about 125 g/L, potassium sodium tartrate with a concentration of about 50 g/L, ferric chloride with a concentration of about 1.5 g/L, and sodium nitrite with a concentration of about 2 g/L. The temperature is about 23° C. and the time is about 60 seconds.

(8) Cyanide-Free Alkaline Copper Electroplating.

The CuMac Strike XD7453 electroplating solution (MacDermid Co., US) is used, which comprises CuMac Strike Make up solution with a concentration of about 150 ml/L, Equivalent Copper Metal with a concentration of about 5.5 g/L, CuMac Strike Stabilizer with a concentration of about 65 ml/L, and CuMac Strike Buffer with a concentration of about 50 ml/L. The temperature is about 50° C., the cathodic current density is about 1 A/dm$^2$, the pH value is about 9.5, and the electroplating time is about 5 minutes.

(9) Acid Copper Electroplating.

The Ultra acid copper electroplating solution (Atotech Co., China) is used, which comprises $CuSO_4.5H_2O$ with a concentration of about 220 g/L, $H_2SO_4$ with a concentration of 50 g/L, chlorine ion with a concentration of about 100 mg/L, ULTRA Make Up with a concentration of about 8 ml/L, a smoothing agent ULTRA A with a concentration of about 0.4 ml/L, a brightening agent ULTRA B with a concentration of about 0.5 ml/L. The conditions of acid copper electroplating comprise a temperature of about 25° C., and a cathodic current density of about 4 A/dm$^2$. The anode is a copper ball containing phosphorus of about 0.05% by weight. The electroplating time is about 30 minutes. The solution is stirred and filtered continuously during the electroplating process.

(10) Activating Treatment.

The activating solution is a $H_2SO_4$ solution with a mass fraction of about 5%. The activating time is about 1 minute, and the activating temperature is room temperature.

(11) Cu—Sn Alloy Electroplating.

The FSC white Cu—Sn electroplating solution (Mateys Co., GuangZhou) is used, which comprises potassium pyrophosphate with a concentration of about 320 g/L, copper pyrophosphate with a concentration of about 10 g/L, stannous pyrophosphate with a concentration of about 20 g/L, a complexing agent FCS-A with a concentration of about 100 ml/L, a stabilizing agent FCS-B with a concentration of about 20 ml/L, and a brightening agent FCS-C with a concentration of about 15 ml/L. The temperature is about 25° C., the cathodic current density is about 0.8 A/dm$^2$, the pH value is about 8.5, and the electroplating time is about 10 minutes.

(12) Activating Treatment.

The activating solution is a HCl solution with a mass fraction of about 5%. The activating time is about 30 seconds and the activating temperature is room temperature.

(13) Trivalent Chromium Electroplating.

The TVC-trivalent chromium electroplating solution (Shangma Technology Co., Ltd. Shenzhen) is used, which comprises TVC-BC with a concentration of about 425 ml/L, a stabilizing agent TVC-CAT with a concentration of about 65 ml/L, a wetting agent TVC-MS with a concentration of about 3 ml/L, a complexing agent TVC-EXT with a concentration of about 2 ml/L, and trivalent chromium with a concentration of about 22 g/L. The temperature is about 35° C., the cathodic current density is about 30 A/dm$^2$, the pH value is about 2.8, and the electroplating time is about 2 minute. The solution is stirred mechanically and filtered continuously during the electroplating.

The alloy is washed with water after each step.

The electroplated product is labeled as A4.

Control 1

The substrate material is YL177 aluminum alloy (the same as EXAMPLE 2). It is treated with the following steps.

The steps (1)-(6) are the same as described in EXAMPLE 1.

(7) Zinc Coating.

The zinc-containing solution comprises zinc oxide with a concentration of about 40 g/L, sodium hydroxide with a concentration of about 125 g/L, potassium sodium tartrate with a concentration of about 50 g/L, ferric chloride with a concentration of about 1.5 g/L, and sodium nitrite with a concentration of about 2 g/L. The temperature is about 23° C. and the time is about 45 seconds.

(8) Nickel Plating.

The JS-998 bright electro-less nickel (Ensoo (Tai Zhou) Chemicals Co., Ltd.) is used. The electroplating solution comprises JS-998A with a concentration of about 60 ml/L, and JS-998B with a concentration of about 150 ml/L. The temperature is about 88° C., the pH value is about 4.7, and the electroplating time is about 25 minutes.

(9) Acid Copper Electroplating.

The Ultra acid copper electroplating solution (Atotech Co., China) is used, which comprises $CuSO_4.5H_2O$ with a concentration of about 220 g/L, $H_2SO_4$ with a concentration of about 50 g/L, chlorine ion with a concentration of about 100 mg/L, ULTRA Make Up with a concentration of about 8 ml/L, a smoothing agent ULTRA A with a concentration of about 0.5 ml/L, a brightening agent ULTRA B with a concentration of about 0.5 ml/L. The conditions of acid copper electroplating comprise a temperature of about 25° C., and a cathodic current density of about 4 A/dm$^2$. The anode is a copper ball containing phosphorus of about 0.05% by weight. The electroplating time is about 25 minutes. The solution is stirred and filtered continuously.

(10) Activating Treatment.

The activating solution is a $H_2SO_4$ solution with a mass fraction of about 5%. The activating time is about 30 seconds, and the activating temperature is room temperature.

(11) Semi-Bright Nickel Plating.

The SM-600 sulfurate-free semi-bright nickel electroplating solution (International Chemical Industry Co., Ltd) is used, which comprises nickel sulfate with a concentration of about 250 g/L, nickel chloride with a concentration of about 50 g/L, boric acid with a concentration of about 45 g/L, an auxiliary agent SM-A 600A with a concentration of about 10 ml/L, a stabilizing agent SM-A 600C with a concentration of about 0.4 ml/L, a brightening agent SM-A 600B with concentration of about 0.6 ml/L, and a Ni-905 wetting agent with a concentration of about 3 ml/L. The temperature is about 55° C., the cathodic current density is about 2 A/dm$^2$, the pH value is about 3.8, and the electroplating time is about 5 minutes.

(12) Bright Nickel Plating.

The NIKEL 88 BRIGHTNISM bright nickel 88 electroplating solution (Atotech Co., China) is used, which comprises nickel sulfate with a concentration of about 250 g/L, nickel chloride with a concentration of about 55 g/L, boric acid with a concentration of about 40 g/L, a Ni SA-1 auxiliary agent with a concentration of about 4 ml/L, an A-5 (4×) softening agent with a concentration of about 10 ml/L, a Ni 88 main brightening agent with a concentration of about 0.75 ml/L, a Ni Y-19 wetting agent with a concentration of about 1.5 ml/L. The temperature is 55° C., the cathodic current density is about 4 A/dm$^2$, the pH value is about 4.3, and the electroplating time is about 10 minutes.

(13) Activating Treatment.

The activating solution is a HCl solution with a mass fraction of about 5%. The activating time is about 30 seconds, and the activating temperature is room temperature.

(14) Trivalent Chromium Electroplating.

The TVC-trivalent chromium electroplating solution (Shangma Technology Co., Ltd. Shenzhen) is used, which comprises TVC-BC with a concentration of about 420 ml/L, a stabilizing agent TVC-CAT with a concentration of about 65 ml/L, a wetting agent TVC-MS with a concentration of about 3 ml/L, a complexing agent TVC-EXT with a concentration of about 2 ml/L, and trivalent chromium with a concentration of about 22 g/L. The temperature is about 32° C., the cathodic current density is about 14 A/dm$^2$, the pH value is about 2.8, the electroplating time is about 2 minute. The solution is stirred mechanically and filtered continuously.

The alloy is washed with water after each step.

The electroplated product is labeled as AC1.

Testing

1. Cross-Cut Testing

The testing standard ISO 2409 is used.

Using a cutting device and cutting guide, cuts are made into the coating layer to a depth sufficient to expose the substrate. The cuts form several squares with similar sizes. The width of the coating between each cutting line is about 1 millimeter. For the products with a small surface, cutting lines form crosses. The surfaces of the samples are brushed by 5 times along the direction of the cutting lines. Then a 3M tape is applied onto the surfaces. The tape is adhered closely onto the surface of the coated products. Within about 5 minutes, the adhesive tape is lifted and removed in about 0.5 to 1 second from a direction of about 60° with the surfaces of the products.

The qualities of the products are ranked on a scale of 0-4, with 0-1 being passed. For the products with crossing cuttings, they are acceptable if the coating is not peeled off or the cutting lines are not enlarged. Scale 0 is assigned to the products with smooth cutting edges and no coating being peeled off. Scale 1 is assigned to the products where the peeled coating area is less than 5%. Scale 2 is assigned to the products where the peeled coating area is between 5% and 15%. Scale 3 is assigned to the products where the peeled coating area is between 15% and 35%. Scale 4 is assigned to the products where the peeled coating area is between 35% and 65%.

2. Vibratory Wear Testing

The abrasives are placed into a tank of a vibratory wear machine. The amount of abrasives are about 15 L, including 3 parts of yellow cone particles (Rösler wear particles RKF 10K) and 1 part of green pyramid particles (Rösler wear particles RKFK 15P). The abrasives are immersed in 2 L of water and wore for 4 hours in the machine.

The abrasives remained wet before and in the testing process. Therefore, before testing, 1 L of water is added into the tank. The mixture of about 0.1 to 0.2 liters of Rösler cleaning agent FC120 and water (with a ratio of 0.1 L of cleaning agent to 5 liters water) are added into the tank before the test. Then the product is placed into the tank and tested. During the test, about 0.5 liters water is added in every half hour.

The products are acceptable if corners are not worn out after 1 hour of testing, and the other parts are not worn out after 2 hour of testing.

3. Salt Mist Endurance Testing

Salt mist (NaCl with a mass fraction of about 5%, and pH of about 6.5 to 7.2) is sprayed on the products at 35° C. for 2 hours. Then the products are placed in a chamber at 40° C. with a humidity of 80% for 168 hours.

The products are acceptable if 2 hours after testing, the products do not show any visible corrosion, oxidation, or deformation without washing.

4. Thermal Shock Testing

The products are placed in a chamber at −40° C. for 2 hours, and then they are transferred to another chamber at 85° C. for 2 hours. The transferring time is less than 3 minutes.

These processes are repeated for 5 times and lasted for about 20 hours. The products are placed at room temperature for 2 hours after the test.

The products are acceptable if the mechanical properties of the products are normal, and the mechanical components of the products are not damaged.

The test results are shown in table 1.

TABLE 1

| | Cross-Cut Testing | Vibratory Wear Testing | Thermal Shock Testing | Salt Mist Endurance Testing | Appearance of Surfaces |
|---|---|---|---|---|---|
| A1 | Scale 0 | Not wear out after 2 hours | No bubbles after 5 times | No corrosion after 168 hours | Smooth |
| A2 | Scale 0 | Not wear out after 2 hours | No bubbles after 5 times | No corrosion after 168 hours | Smooth |
| A3 | Scale 0 | Not wear out after 2 hours | No bubbles after 5 times | No corrosion after 168 hours | Smooth |
| A4 | Scale 0 | Not wear out after 2 hours | No bubbles after 5 times | No corrosion after 168 hours | Smooth |
| AC1 | Scale 1 | Not wear out after 2 hours | Bubbles after 5 times | No corrosion after 168 hours | Pits |

According to the test results, the electroplated product A2 has a coating with better qualities.

Many modifications and other embodiments of the present disclosure will come to mind to one skilled in the art to which the present disclosure pertains having the benefit of the teachings presented in the foregoing description. It will be apparent to those skilled in the art that variations and modifications of the present disclosure can be made without departing from the scope or spirit of the present disclosure. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method for electroplating a substrate having an aluminum alloy surface comprising:

applying a zinc layer onto the aluminum alloy surface;

electroplating a first copper layer onto the zinc layer from an alkaline copper electroplating solution, wherein the alkaline copper solution is substantially free of cyanide ion;

electroplating a second copper layer onto the first copper layer from an acid copper electroplating solution;

electroplating a Cu—Sn alloy layer onto the second copper layer from a Cu—Sn electroplating solution; and electroplating a chromium layer onto the Cu—Sn alloy layer from a trivalent chromium solution, wherein the method is substantially free of nickel and cyanide.

2. The method of claim 1, wherein the zinc layer is formed by placing the aluminum alloy in a zinc-containing solution;

wherein the zinc-containing solution comprises zinc oxide, sodium hydroxide, potassium sodium tartrate, ferric chloride, sodium nitrite, and water; and wherein the concentration of zinc oxide is between about 20 and about 60 g/L, the concentration of sodium hydroxide is between about 100 and about 130 g/L, the concentration of potassium sodium tartrate is between about 40 and about 60 g/L, the concentration of ferric chloride is between about 0.5 and about 2.5 g/L, and the concentration of sodium nitrite is between about 0.5 and about 4 g/L.

3. The method of claim 2, wherein the temperature of the zinc-containing solution is between about 20 and about 28° C.; and the aluminum alloy is placed in the zinc-containing solution for between about 40 seconds and about 2 minutes.

4. The method of claim 1, wherein the alkaline copper electroplating solution comprises potassium pyrophosphate, copper pyrophosphate, a stabilizing agent, a brightening agent, and water; and wherein the concentration of potassium pyrophosphate is between about 350 and about 420 g/L, the concentration of copper pyrophosphate is between about 15 and about 25 g/L, the concentration of the stabilizing agent is between about 65 and about 85 ml/L, and the concentration of the brightening agent is between about 15 and about 25 ml/L.

5. The method of claim 1, wherein the temperature of the alkaline copper electroplating solution is between about 35 and about 60° C.; the pH of the alkaline copper electroplating solution is between about 9.2 and about 10.0; the electroplating cathodic current density of the first copper layer is between about 0.5 and about 2.5 A/dm$^2$; and the electroplating time for the first copper layer is between about 5 minutes and about 20 minutes.

6. The method of claim 1, wherein the acid copper electroplating solution comprises $CuSO_4$, $H_2SO_4$, chloride ion, an auxiliary agent, a smoothing agent, a brightening agent, and water; and wherein the concentration of $CuSO_4$ is between about 180 and about 250 g/L, the concentration of $H_2SO_4$ is between about 50 and about 70 g/L, the concentration of chloride ion is between about 40 and about 100 mg/L, the concentration of the auxiliary agent is between about 8 and about 10 ml/L, the concentration of the smoothing agent is between about 0.4 and about 0.6 ml/L, and the concentration of the brightening agent of about 0.4 and about 0.6 ml/L.

7. The method of claim 1, wherein the temperature of the acid copper electroplating solution is between about 20 and about 30° C., and the cathodic current density of the second copper layer is between about 3 and about 5 A/dm$^2$; the electroplating time for the second copper layer is between about 15 minutes and about 40 minutes; and wherein an anode is made of copper containing phosphorus in about 0.03 to 0.06% by weight.

8. The method of claim 1, wherein the electroplating of the second copper layer further comprises steps of:

stirring the copper solution; and filtering the copper solution.

9. The method of claim 1, wherein the Cu—Sn electroplating solution comprises potassium pyrophosphate, copper pyrophosphate, stannous pyrophosphate, a complexing agent, a stabilizing agent, and a brightening agent;

wherein the concentration of potassium pyrophosphate is between about 250 and about 350 g/L, the concentration of copper pyrophosphate is between about 5 and about 12 g/L, the concentration of stannous pyrophosphate is between about 15 and about 35 g/L, the concentration of the complexing agent is between about 80 and about 120 ml/L, the concentration of the stabilizing agent is between about 10 and about 30 ml/L, and the concentration of the brightening agent is between about 10 and about 20 ml/L.

10. The method of claim 1, wherein the temperature of the Cu—Sn electroplating solution is between about 15 and about 30° C.; the pH of the Cu—Sn electroplating solution is between about 8.0 and about 8.8; the electroplating cathodic current density of the Cu—Sn alloy layer is between about 0.5 and about 1 $A/dm^2$; and the electroplating time for the Cu—Sn alloy layer is between about 5 minutes and about 15 minutes.

11. The method of claim 1, wherein the trivalent chromium electroplating solution comprises an auxiliary agent, a stabilizing agent, a wetting agent, a complexing agent and a trivalent chromium compound; and wherein the auxiliary agent is between about 400 and about 450 ml/L, the stabilizing agent is between about 55 and about 75 ml/L, the wetting agent is between about 2 and about 5 ml/L, the complexing agent is between about 1 and about 3 ml/L, and trivalent chromium is between about 20 and about 25 g/L.

12. The method of claim 1, wherein the temperature of the trivalent chromium electroplating solution is between about 28 and about 35° C.; the pH of the trivalent chromium electroplating solution is between about 2.5 and about 3.0; the electroplating current density of the chromium layer is between about 8 and about 30 $A/dm^2$; and the electroplating time for the chromium layer is between about 1 minutes and about 5 minutes.

13. The method of claim 1, wherein the electroplating of the chromium layer further comprises steps of:

stirring the chromium solution; and filtering the chromium solution.

14. The method of claim 1, further comprising a step of treating the aluminum alloy surface.

15. The method of claim 1, further comprising a step of washing with water after at least one step of electroplating.

16. A method for electroplating a substrate having an aluminum alloy surface comprising:

applying a zinc layer onto the aluminum alloy surface;

electroplating a first copper layer onto the zinc layer from an alkaline copper electroplating solution, wherein the alkaline copper solution is substantially free of cyanide ion;

electroplating a second copper layer onto the first copper layer from an acid copper electroplating solution;

applying an activating solution onto the second copper layer;

electroplating a Cu—Sn alloy layer onto the second copper layer from a Cu—Sn electroplating solution; and electroplating a chromium layer onto the Cu—Sn alloy layer from a trivalent chromium solution, wherein the method is substantially free of nickel and cyanide.

17. The method of claim 16, wherein the activating solution is an acid.

18. The method of claim 17, wherein the acid is a $H_2SO_4$ solution.

19. The method of claim 16, further comprising a step of applying a solution onto the Cu—Sn alloy layer.

* * * * *